US006641418B2

(12) United States Patent
Takahashi et al.

(10) Patent No.: US 6,641,418 B2
(45) Date of Patent: Nov. 4, 2003

(54) LAMP SOCKET

(75) Inventors: Tetsuya Takahashi, Tokyo (JP); Kensaku Sato, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/084,300

(22) Filed: Feb. 28, 2002

(65) Prior Publication Data

US 2002/0136007 A1 Sep. 26, 2002

(30) Foreign Application Priority Data

Mar. 21, 2001 (JP) ..... 2001-081305
Mar. 26, 2001 (JP) ..... 2001-086793

(51) Int. Cl.[7] ..... H01R 33/945
(52) U.S. Cl. ..... 439/226; 439/620; 313/318.12
(58) Field of Search ..... 439/620, 36, 226, 439/231; 313/318.03, 318.12

(56) References Cited

U.S. PATENT DOCUMENTS 4,853,583 A * 8/1989 Ridders et al. ..... 313/318.02
5,814,927 A * 9/1998 Chen ..... 362/226 X
6,049,163 A * 4/2000 Masuda et al. ..... 313/318.12

FOREIGN PATENT DOCUMENTS

WO WO 90/07209 * 6/1990

* cited by examiner

*Primary Examiner*—Renee Luebke
(74) *Attorney, Agent, or Firm*—Kanesaka & Takeuchi

(57) ABSTRACT

An inside unit (54) is housed in the unit receiving section 81 of a lamp socket (1). The central terminal (3) is connected to the high-voltage output terminal (76) of the inside unit (54) and mounted in the terminal aperture (11A) of a terminal mount (11) at the center of the lamp socket (1). The low-voltage output terminal (77) of the inside unit (54) is connected to the side terminal (4) of the lamp socket (1).

7 Claims, 11 Drawing Sheets

LAMP SOCKET

BACKGROUND OF THE INVENTION

1. Field of the Invention

The present invention relates to lamp sockets for an automobile headlight or the like.

2. Description of the Related Art

Recently, discharge lamps, which are brighter, lower in power consumption, and longer in useful life than halogen lamps, are widely used for automobile headlight in consideration for safety. It is necessary to apply a high voltage above 13 kV to the discharge lamp for automobile headlight at the starting time. The starter circuit for applying the high voltage at the starting time and the lamp socket into which a lamp is mounted are made separately, resulting in the large number of components and large space occupied by the components.

Japanese patent application Kokai No. 10-214733 proposed that the starter circuit is housed in the socket body of a lamp socket to reduce the number of components and the space.

It comprises a coil bobbin around which a secondary coil is wound, a core placed in the bobbin, a coil case for housing the bobbin, a primary coil wound around the coil case to form a high-voltage transformer, an ignition circuit for a discharge lamp mounted on a printed circuit board, a housing for receiving the printed circuit board and a lamp socket, and a dielectric resin filled in the housing to form a discharge lamp unit.

However, the above discharge lamp unit is made by putting the high-voltage transformer and the print circuit board in the housing and filling the housing with a resin to provide the unit so that the number of assembling steps is too large to do it readily.

Japanese patent application Kokai No. 10-223005 proposed that the starter circuit is housed in the socket body of a lamp socket.

It comprises a body case having a socket section provided on a side of the transformer receiving section for connection with a discharge lamp. An ignition transformer, which is housed in the transformer receiving section, has a secondary coil for connection with the central high-voltage output terminal of the socket section. The primary coil is connected to the low-voltage output terminal provided on the side of the socket section via a circuit section.

However, this lamp socket has no separation member between the high-voltage and low-voltage output terminals and fails to meet the required high break-down voltage, producing a spark between the terminals and a leak of the high-voltage.

SUMMARY OF THE INVENTION

Accordingly, it is an object of the invention to provide a lamp socket that needs neither resin filling nor large number of assembling steps while keeping the electronics components incorporated.

It is another object of the invention to provide a lamp socket that is able to provide a high break-down voltage and eliminate a spark between the terminals and a leak of the high-voltage.

According to an aspect of the invention there is provided a lamp socket comprising a socket body with a socket cavity into which a plugging section of a lamp is plugged; a central terminal provided at a center of said socket cavity for contact with a lamp terminal of said lamp; a side terminal provided in a side wall of said socket cavity for contact with a contact section of said plugging section; a unit receiving section provided in said socket body at a position opposite to said socket cavity; said socket body, said central terminal, said side terminal, and said unit receiving section constituting a lamp socket unit; an inside unit including a circuit section for starting said lamp and high-voltage and low-voltage output terminals connected to said circuit section; said inside unit being housed in said unit receiving section such that said high-voltage and low-voltage output terminals are brought into contact with said central and side terminals, respectively.

By housing the inside unit in the unit receiving section and bringing the high-voltage and low-voltage output terminals into contact with the central and side terminals, respectively, it is possible to assemble the lamp socket in a small number of assembling steps while keeping the electronics components incorporated.

The lamp socket according to the invention may further comprise a connector section for connecting said circuit section to a power source. The connector section facilitates a supply of electrical power to the inside unit. The lamp socket according to the invention may further comprise a cover for covering said inside unit in said unit receiving section. The inside unit may comprise a board of a conductive plate; a unit body including said board; a plurality of electronics components mounted on said board to form said circuit section. This configuration makes it easier to assemble the lamp starter circuit and the electronics components unit.

According to another aspect of the invention there is provided a lamp socket comprising a socket body with a socket cavity into which a plugging section of a lamp is plugged; a central terminal provided at a center of said socket cavity for contact with a lamp terminal of said lamp; a side terminal provided in a side wall of said socket cavity for contact with a contact section of said plugging section; a unit receiving section provided in said socket body at a position opposite to said socket cavity; said socket body, said central terminal, said side terminal, and said unit receiving section constituting a lamp socket unit; an inside unit including a circuit section for starting said lamp and high-voltage and low-voltage output terminals connected to said circuit section; said unit receiving section being divided into first and second storage rooms such that said first and second storage rooms receive said central and side terminals, respectively; a seal abutment section provided in either said first storage room or said inside unit so as to surround said central terminal; a seal mounting section provided in said second storage room so as to surround said high-voltage output terminal; a dielectric seal member provided in the seal mounting section; said inside unit being housing in said unit receiving section so that not only said high-voltage and low-voltage terminals are brought into contact with said central and side terminals, respectively, but also said dielectric seal member into abutment with said seal abutment section.

The lamp socket may further comprises a separation wall in said unit receiving section so as to separate said first and second storage rooms or a connection terminal for connecting said low-voltage output terminal with said side terminal to bring said low-voltage output terminal to said side terminal. The lamp socket is assembled by placing the inside unit in the unit receiving section such that the high-voltage and low-voltage output terminals are brought into contact with the central and side terminals to assemble the lamp socket. The dielectric seal member separates the high-voltage and low-voltage output terminals to provide a high break-down voltage and prevent a spark between them and a leak of the high-voltage.

DESCRIPTION OF THE PREFERRED EMBODIMENTS

Figure 1:
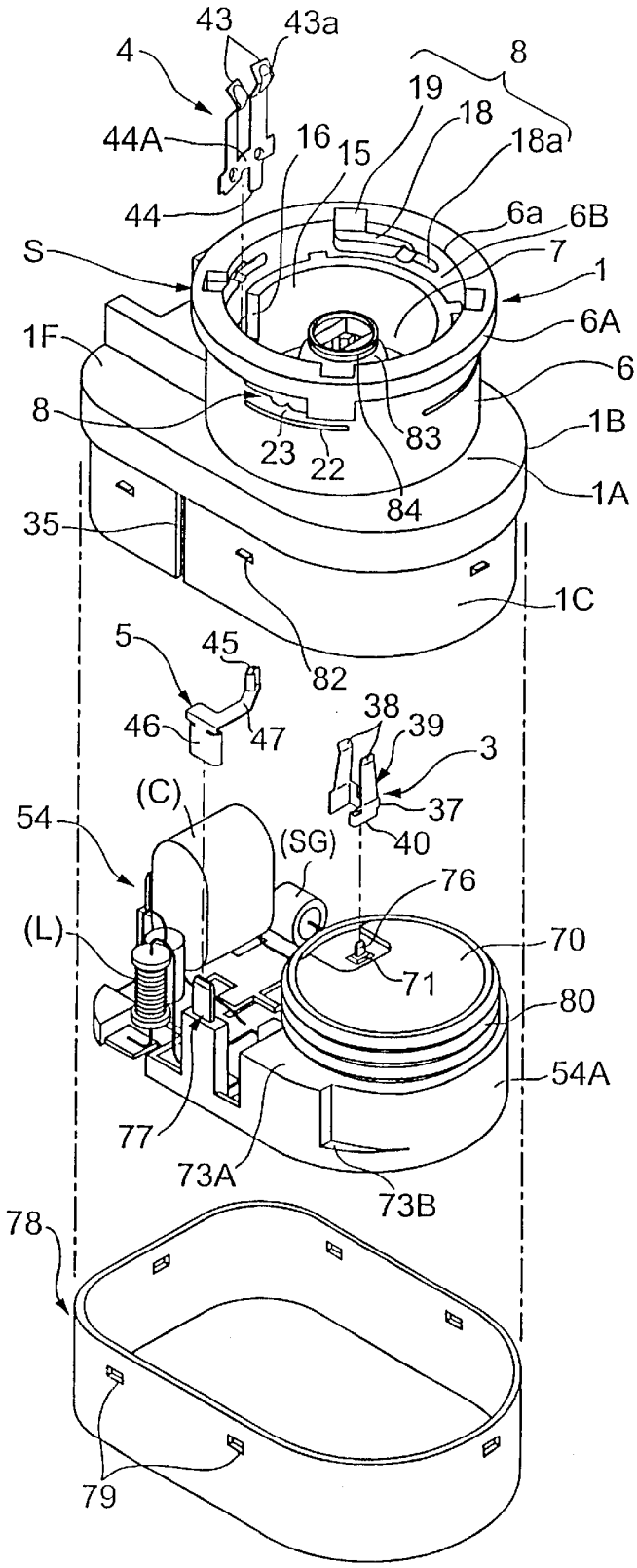
FIG. 1 is an exploded perspective view of a lamp socket according to an embodiment of the invention.

Embodiments of the invention will now be described with reference to the accompanying drawings.

A lamp socket A comprises a lamp socket section 1 for receiving a removable lamp B, a connection terminal 5, an inside unit 54, and a cover 78. A central terminal 3 and a side terminal 4 are mounted at the center and the side wall of a socket body 1A, respectively. The inside unit 54 comprises a high-voltage starter circuit E for starting a discharge lamp B and a connector section F for connecting the starter circuit E to an ignition circuit (not shown). The ignition circuit transfers power from a d-c power supply, such as a battery, to the discharge lamp B.

Figure 14:
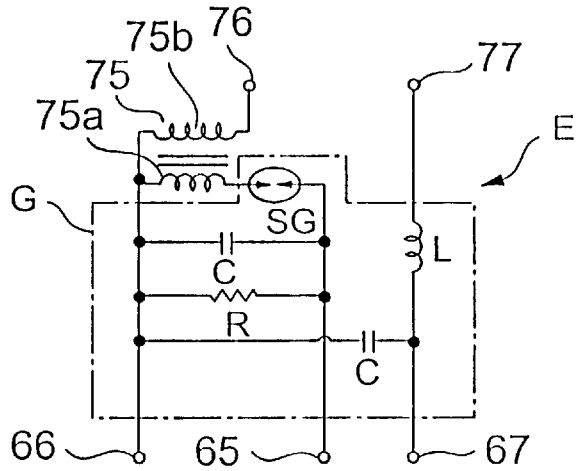
FIG. 14 is a circuit diagram for the lamp socket.

As shown in FIG. 14, the starter circuit E comprises a main circuit G having a well-known configuration that is made up of electrical components, such as a spark gap (SG), capacitors (C), an inductor (L), a resistor (R), and a diode (D), to produce high-voltage pulses from the output of the ignition circuit and a pulse transformer 75 having a primary winding 75*a* for receiving the high-voltage pulses from the main circuit G and a secondary winding 75*b* for supplying a higher-voltage pulses to the lamp B.

As shown in FIGS. 1–8, the socket body 1A has a base section 1B having a square front 1F and a round back, a cylindrical section 6 extending upwardly from the base section 1B, an inside wall 15 concentric with the cylindrical section 6. A flange portion 6A extends outwardly from the front or upper edge 6*a* of the cylindrical section 6 to make the front edge 6*a* thicker than the remaining part. A socket cavity 7 and a lamp engagement section 8 are provided in the cylindrical section 6. The socket cavity 7 is an annular space between the tubular section 10 and the inside wall 15. A central terminal mount 11 extends upwardly from the bottom of the tubular section 10 and a side terminal mount 12 is provided on the side wall of the socket cavity 7.

The central terminal mount 11 has a terminal mounting aperture 11A around which a pair of opposed terminal leg grooves 14 and a pair of opposed seal leg grooves 14A are provided. The side terminal mount 12 is separated from the socket cavity 7 by the inside wall 15, through which a terminal outlet 16 is provided. A terminal leg aperture 17 is provided in the bottom of the side terminal mount 12 (see FIGS. 4, 7, and 8). The lamp engagement sections 8 comprises an elongated engaging hole 18 provided 90 degrees apart from each other, an insertion groove 19 provided in the inside face 6B of the cylindrical section 6 and communicating with the engaging hole 18, and a notch portion 18*a* communicating with the engaging hole 18 on the end opposite to the insertion groove 19.

Figure 2:
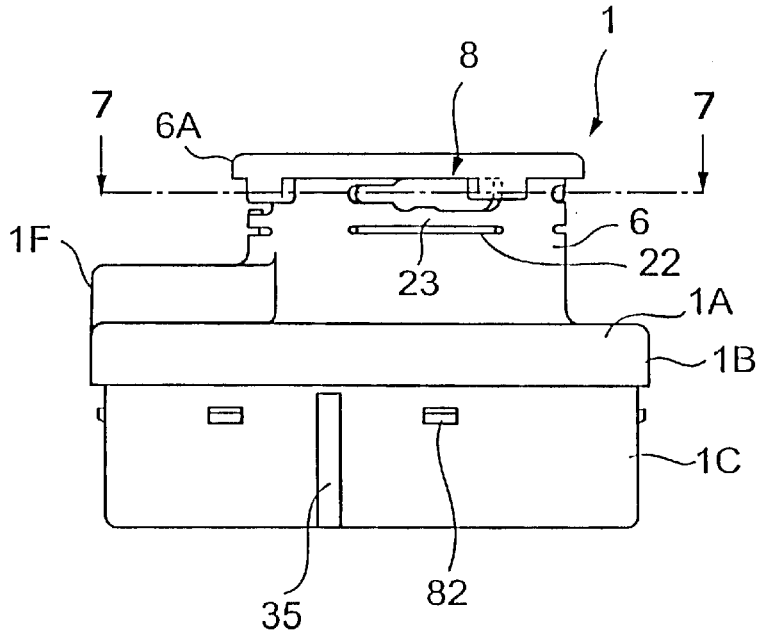
FIG. 2 is a sectional view of a lamp socket section of the lamp socket.
Figure 3:
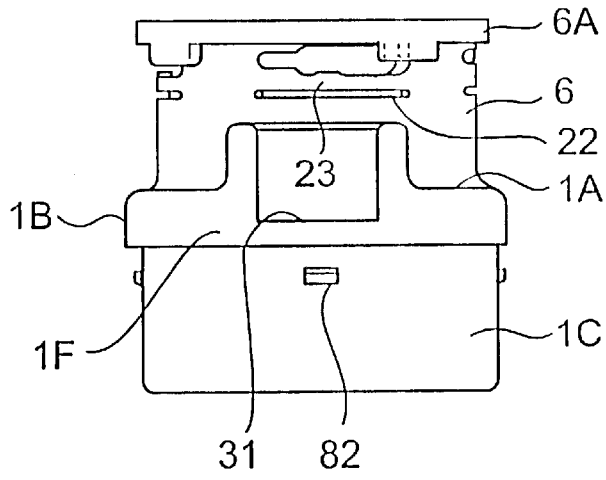
FIG. 3 is a front view of the lamp socket section.
Figure 4:
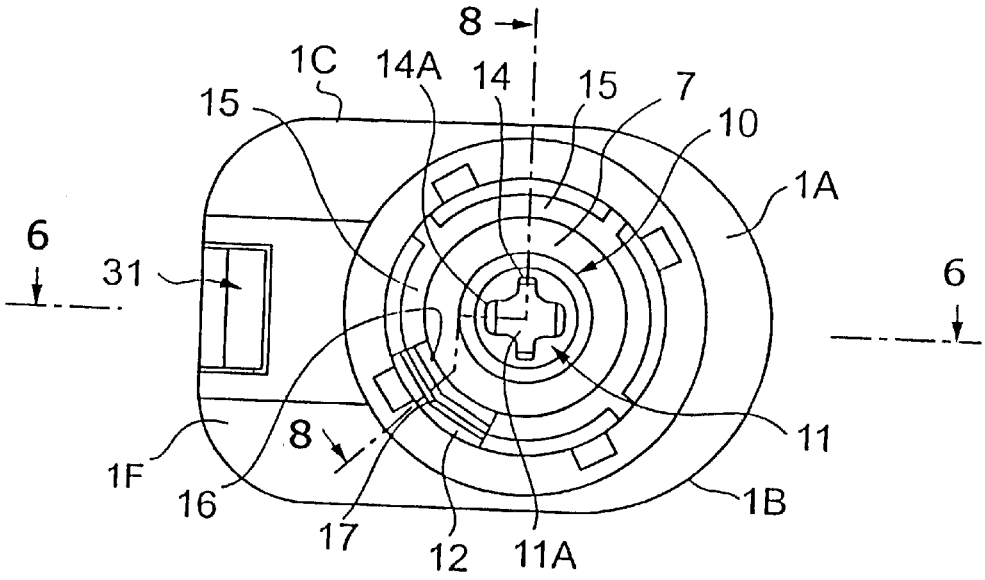
FIG. 4 is a plan view of the lamp socket section.

As best shown in FIGS. 1 and 2, four slits 22 are provided in the cylindrical section 6 in parallel to the engaging holes 18 to form four flexible portions 23 between them.

Figure 5:
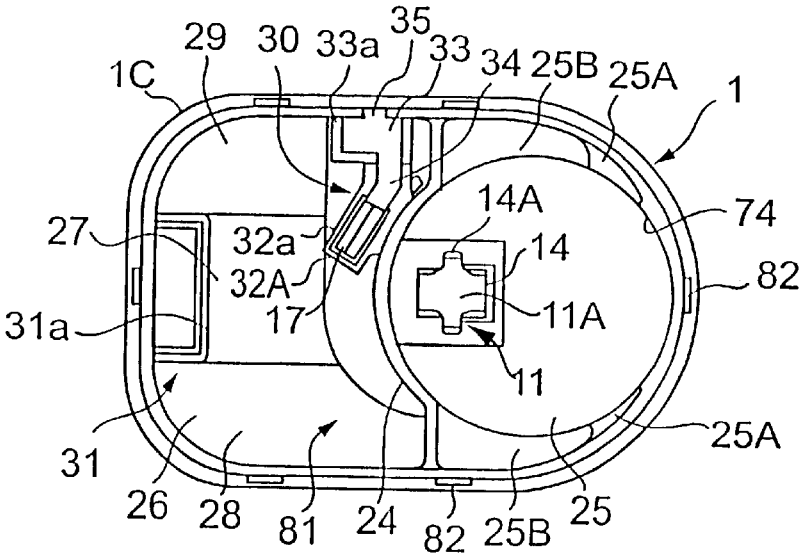
FIG. 5 is a bottom view of the lamp socket section.
Figure 6:
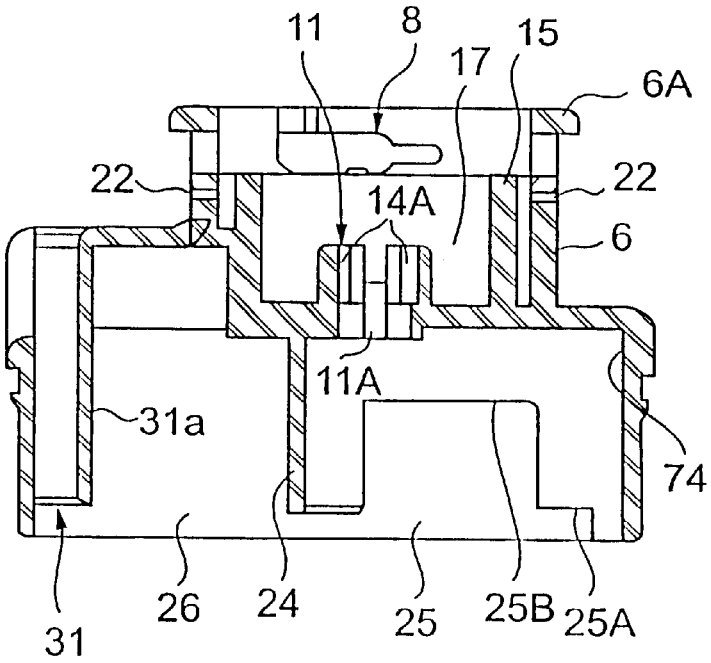
FIG. 6 is a sectional view taken along line 6—6 of FIG. 4.
Figure 7:
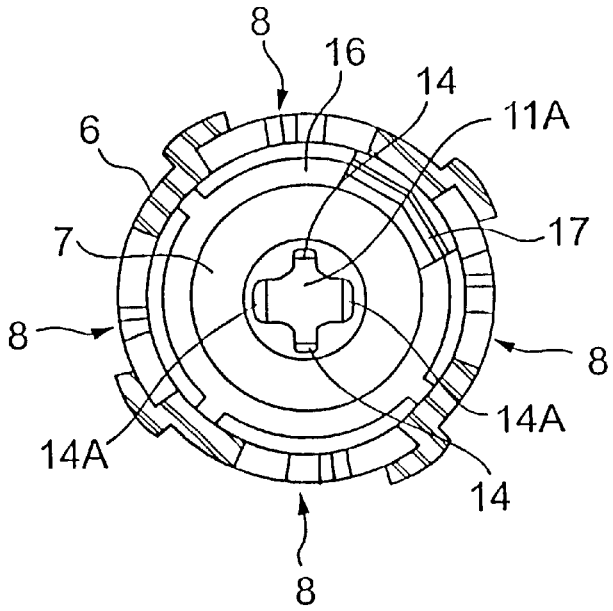
FIG. 7 is a sectional view taken along line 7—7 of FIG. 2.

In FIG. 5, a unit receiving section 81 is provided in the back or bottom of the base section 1B of the socket body 1, and has two storage rooms 25 and 26 separated by a partition wall 24. A terminal aperture 11A is provided in the top of the storage room 25 for the terminal mount 11, in which the terminal leg grooves 14 and the seal-pressing member leg insertion grooves 14A are exposed. A seal abutment section 74 surrounds the terminal aperture 11A in the storage room 25. A pair stepped unit abutment faces 25A and 25B are provided on opposite sides of the storage room 25 to determine the positions of the socket body 1 and the inside unit 54.

The storage room 26 are divided into a central component storage section 27, a pair of component storage sections 28 and 29 on opposite sides of the central storage section 27, a terminal receiving section 30 near the partition wall 24, and a connector receiving section 31 by the front portion of the side wall 1C. The central component storage section 27 is made deeper than the adjacent component storage sections 28 and 29.

The terminal receiving section 30 has an inside receiving portion 32A surrounded by a wall 32*a* in alignment with the terminal leg aperture 17, an outer receiving portion 33 surrounded by a wall 33*a* by the left side wall 1C, and a passage 34 for communicating the inner and outer receiving portions 32A and 33. A vertical slit 35 is provided in the side wall 1C that is a part of the outer receiving portion 33. When the connection terminal 5 is put into the terminal receiving section 30 up to the specified position, a part of the connection terminal 5 is exposed from the slit 35, indicating that the connection terminal 5 has been received. The connector receiving section 31, which is defined by the enclosing wall 31*a*, extends through the front square portion 1F of the base section 1B. A plurality of engaging projections 82 are provided on the outside of the side wall 1C.

Figure 9A:
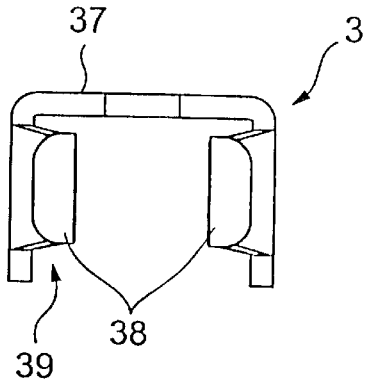
FIGS. 9A–9C are plan, front, and bottom views of a central terminal, respectively.
Figure 9B:
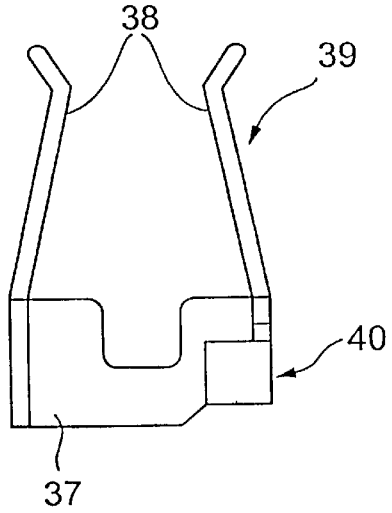
Figure 9C:
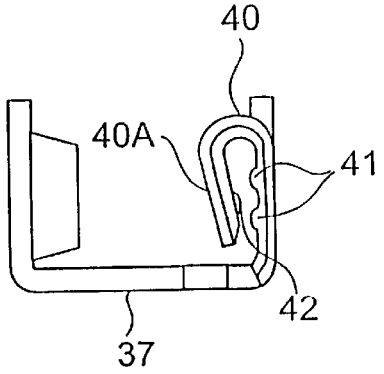
Figure 10A:
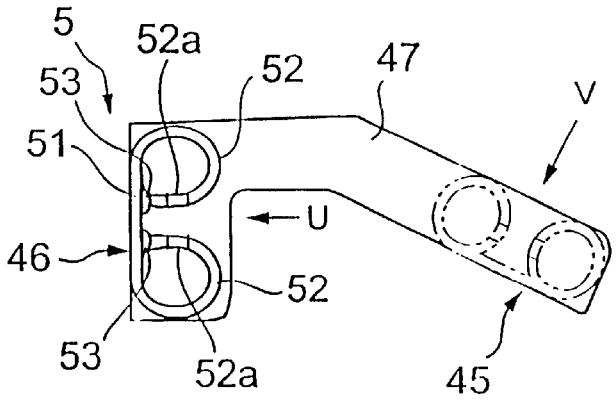
FIG. 10A is a plan view of a connection terminal.
Figure 10B:
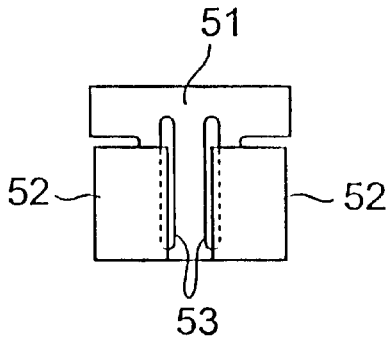
FIGS. 10B–10D are diagrams viewed front arrows U, V, and W, respectively.
Figure 10C:
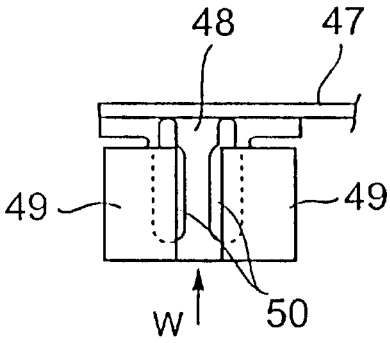
Figure 10D:
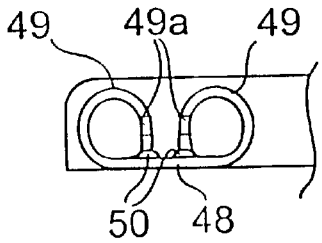
Figure 11:
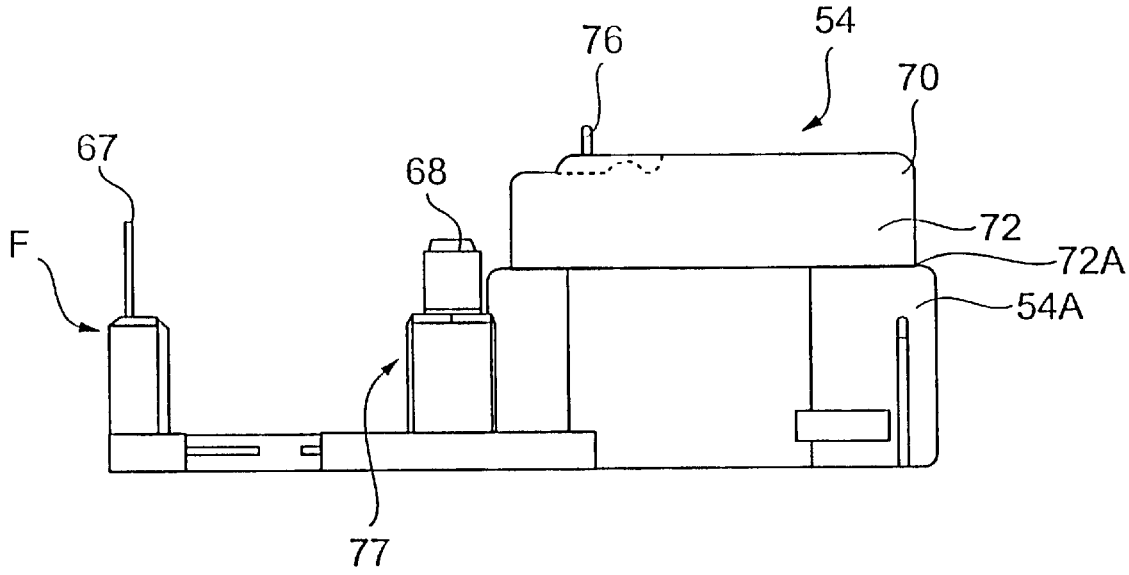
FIG. 11 is a side view of an inside unit for the lamp socket.
Figure 12:
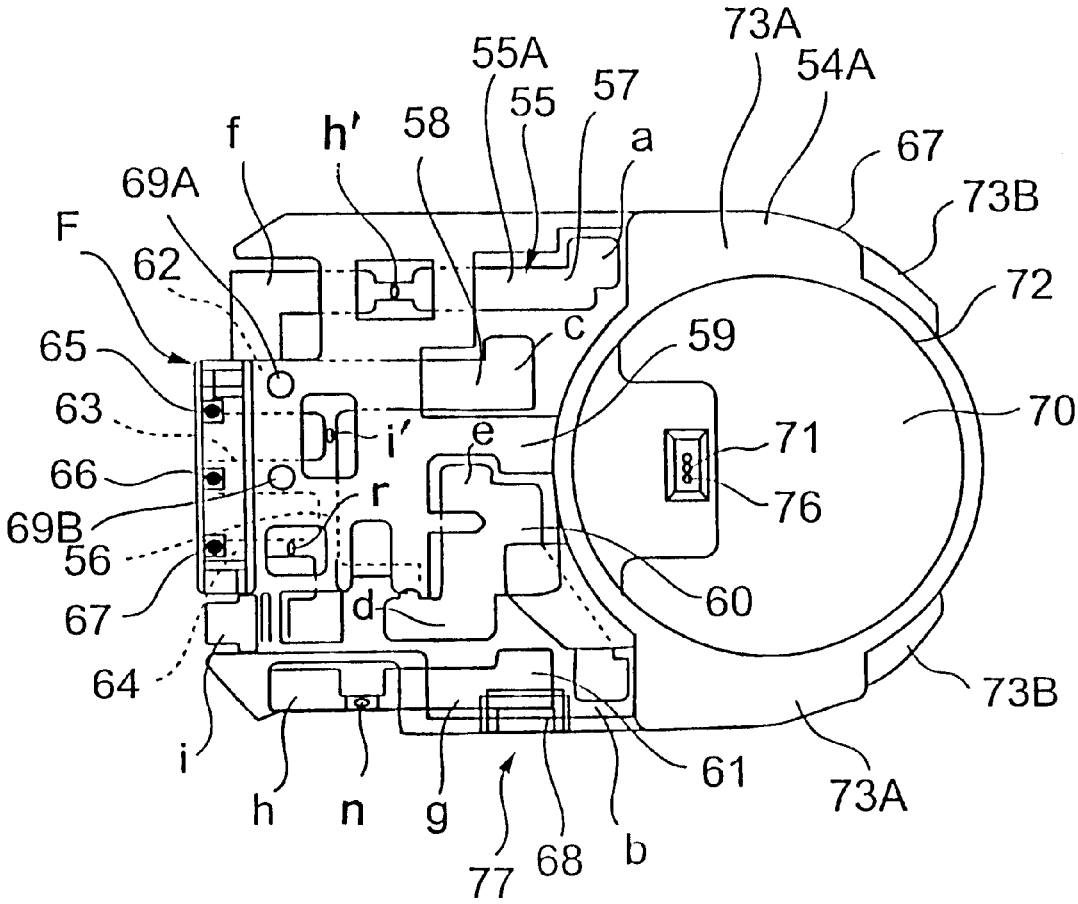
FIG. 12 is a plan view of the inside unit before electronics components are mounted.

In FIGS. 9A–9C, the central terminal 3 has a C-shaped terminal body 37 and a lamp contact section 39 that consists of a pair of opposed contact pieces 38. A connection section 40 is provided at an end of the terminal body 37. The connection section 40 has a folded piece 40A with a contact point 42 thereon and a couple of contact points 41 provided on the terminal body 37 so as to oppose to the folded piece 40A.

Referring back to FIG. 1, the side terminal 4 has a pair of terminal sections 43 with a contact point 43*a* at a tip therof, a linking section 44A for joining the terminal sections 43, and a terminal leg 44 extending from the linking section 44A.

In FIGS. 10A–10D, the connection terminal 5 has an inner connection section 45, an outer connection section 46, and a linking section 47 for joining the inner and outer connection sections 45 and 46. The inner connection section 45 has a bent portion 48 with a pair of curved contact pieces 49 and a pair of contact portions 50 provided on the bent portion 48 so as to oppose to the inner edges 49*a* of the contact pieces 49. The outer connection section 46 has a bent portion 51 with a pair of contact pieces 52 and a pair of contact points 53 provided on the bent portion 51 so as to oppose to the inner edges 52*a* of the contact pieces 52.

As shown in FIGS. 1 and 11–13, the inside unit 54 comprises a board 55 made by stamping a conductive plate, a unit body 54A into which the board 55 is molded, and a starter circuit (E) that is made up of a transformer 75, a capacitor (C), a resistor (R), a spark gap (SG), a chalk coil (L), and a diode (D). The board 55 comprises a board body 55A having first, second, third, fourth, and fifth horizontal sections 57, 58, 59, 60, and 61 and a vertical section 56 having first, second, and third terminal sections 62, 63, and 64, a cutting point (i) between the first and second terminal sections 62 and 63, and a cutting point (r) on the third terminal section 64. Also, cutting points h and n are provided on the first and fifth horizontal sections 57 and 61, respectively.

Contacts 65, 66, and 67 extend upwardly from the first, second, and third terminal sections 62, 63, and 64, respectively, and a contact terminal 68 extends upwardly from the fifth horizontal section 61. Electronics components connection pads a, b, c, d, e, f, g, h, i, and j are provided on the first, second, third, fourth, and fifth horizontal sections 57, 58, 59, 60, and 61. The board 55 is molded with a resin except for the connection pads a, b, c, d, e, f, g, h, i, and j and the cutting points o, r, h, and n to provide the unit body 54A that has a square front and a round rear shape. There are provided a pair of insert retention sections 69A and 69B.

A circular transformer receiving section 70 is provided at the rear portion of the unit body 54A, and a terminal insertion aperture 71 is provided in the top of the transformer receiving section 70. A seal attaching section 72 is provided on the periphery of the transformer receiving section 70. Two pairs of sets of stepped abutment faces 73A and 73B are provided on opposite sides of the transformer receiving section 70 to decide position the socket body 1 and the inside unit 54. The contacts 65, 66, and 67 are molded with a resin except for their front ends to form a connector section F. Also, the contact terminal 68 is molded with a resin except for its front end to form a low-voltage output terminal 77.

Figure 13:
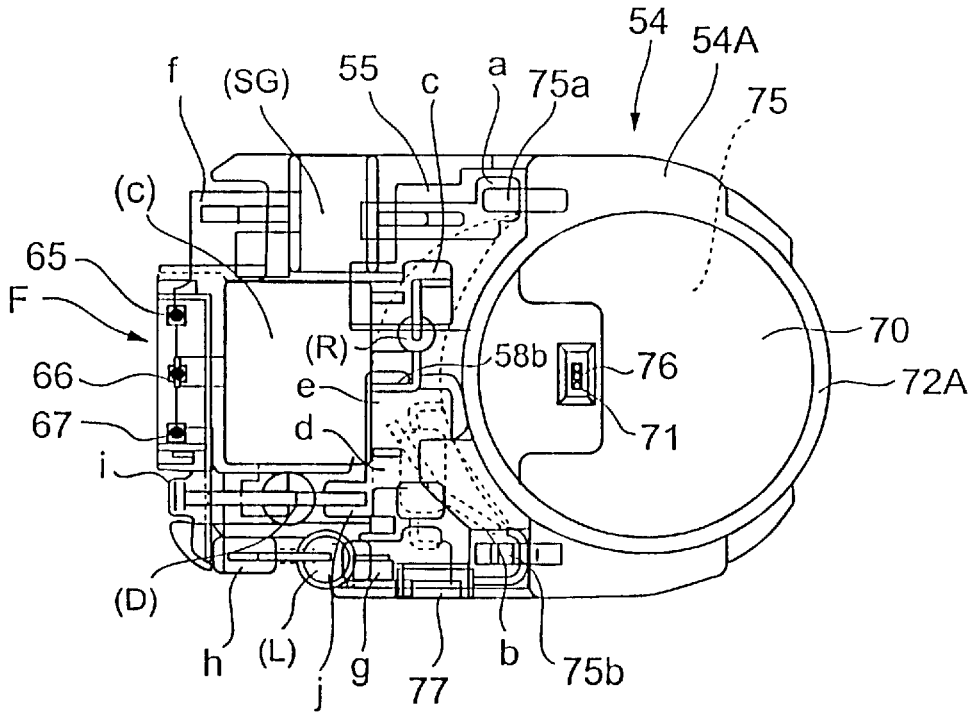
FIG. 13 is a plan view of the inside unit after electronics components are mounted.

After the unit body 54A is cut off at the cutting points o, r, h, and n, a pulse transformer 75 and electronics components are mounted on the transformer receiving section 70 and the connection pads a, b, c, d, e, f, g, h, i, and j, respectively. More specifically, as shown in FIG. 13, the pulse transformer 75 is sealed with a resin in the transformer receiving section 70 such that one of its output terminals or high-voltage output terminal 76 projects through the terminal insertion aperture 75*a*. The connection terminals 75*a* and 75*b* of the transformer 75 are connected (by soldering) to the connection pads a and b, respectively.

The connection terminals of the capacitor (C) and resistor (R) are soldered to the connection pads c and d, and c and e, respectively. Similarly, the connection terminals of the spark gap (SG), the chalk coil (L), and the diode (D) are soldered to the connection pads a and f, g and h, and i and j, respectively. The transformer 75, the capacitor (C), the resistor (R), the spark gap (SG), the chalk coil (L), and the diode (D) are mounted on the board 55 by soldering as stated above to form such a circuit configuration as shown in FIG. 14.

Referring back to FIG. 1, the cover 78 fits over the side wall of the base section 1B of the socket body 1 and has a plurality of engaging holes 79. The side terminal 4 is press-fitted in the terminal attaching section 12 of the socket body 1 such that its contact points 43*a* are exposed in the socket cavity 7 through the terminal exposure portion 16. The terminal leg 44 is press-fitted through the terminal leg aperture 17 of the terminal attaching section 12 into the inside receiving portion 32 of the terminal receiving section 30.

Figure 8:
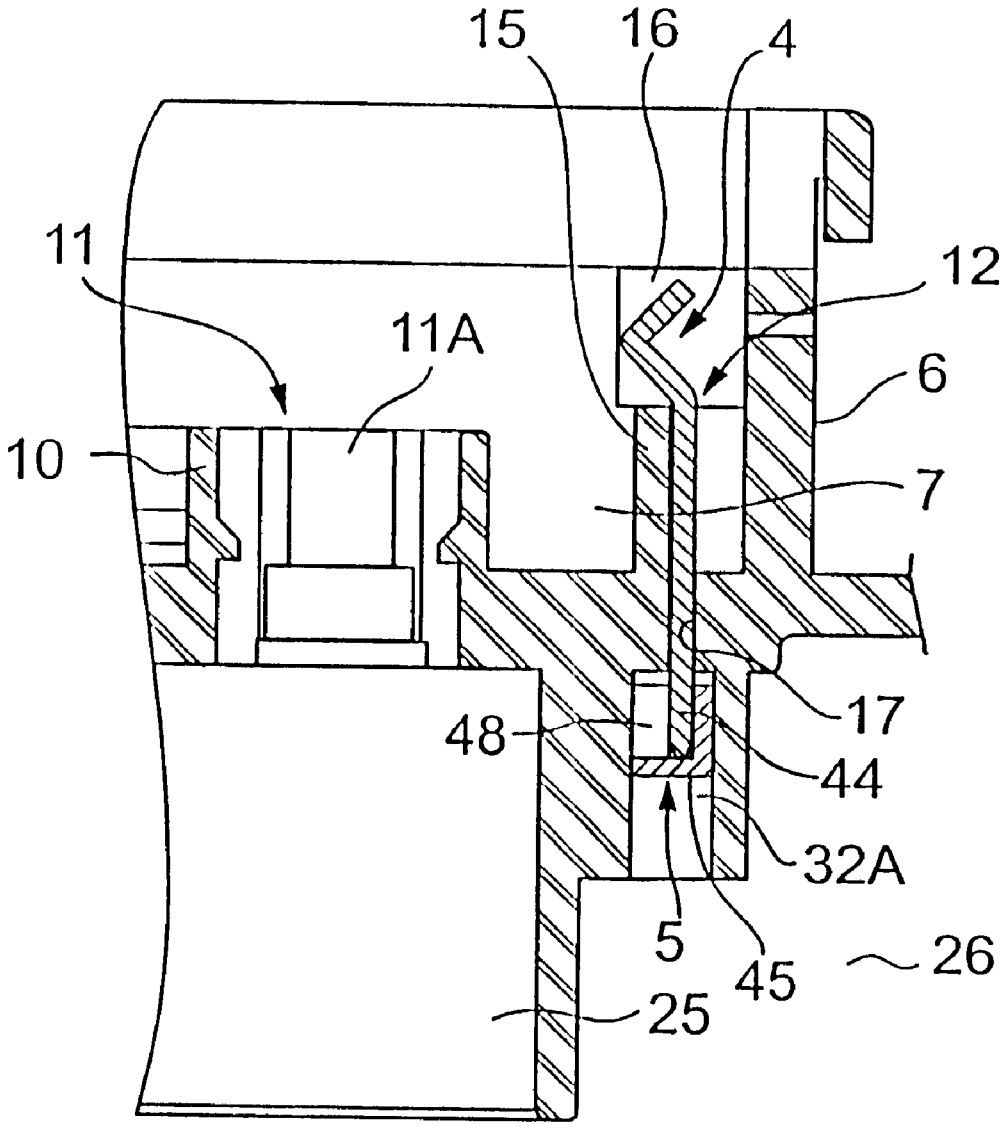
FIG. 8 is a sectional view taken along line 8—8 of FIG. 4.

As shown in FIGS. 1, 5, and 8, the connection terminal 5 is housed in the terminal receiving section 30 such that its inner and outer connection sections 45 and 46 and the linking section 47 are inserted in the inner and outer receiving sections 32A and 33, and the passage section 34, respectively, to connect the inner connection section 45 and the terminal leg 44 of the side terminal 4. This connection is made by bringing the end portion 49*a* and the contact point 50 of the contact piece 49 into contact with the terminal leg 44 of the side terminal 4.

The high-voltage output terminal 76 of the inside unit 54 is connected to the central terminal 3. More specifically, the connection section 40 of the central terminal 3 is fitted over the output terminal 76 to bring the contact points 41 and 42 into contact with the output terminal 76. An annular seal attaching section 72 and a stepped section 72A are provided on the transformer receiving section 70 to support an annular dielectric seal member 80 to prevent sparks between the high-voltage and low-voltage output terminals 76 and 77, thus keeping the high dielectric and break-down characteristics.

The pulse transformer-storage section 70 and the inside unit 54 are put into the storage rooms 25 and 26, respectively, of the unit receiving cavity 81 provided in the bottom of the socket body 1. The stepped abutment sections 73A and 73B of the transformer storage section 70 abut on the unit abutment faces 25A and 25B of the storage room 25 and the insulation seal member 80 abuts on the seal abutment section 74 of the storage room 25.

Alternatively, an annular insulation seal member 80 may be mounted on the storage room 25 for abutment with the seal abutment section 74, and the transformer storage section 70 is put into the storage room 25 and the insulation seal member 80 may abut on the annular seal attaching section 72 of the transformer storage section 70.

The lamp contact section 39, which consists of two opposed contact pieces 38, of the central terminal 3 is put into the terminal leg groove 14 of the central terminal mounting section 11, and the low-voltage output terminal 77 of the inside unit 54 is connected to the outer connection section 46 of the connection terminal 5. This connection is made by bringing the low-voltage output terminal 77 into contact with the end portion 52*a* and the contact point 53 of the contact piece 52. The connector section F of the inner unit 54 is inserted into the connector storage section 31.

As shown in FIG. 1, the insulation seal 83 is mounted on the tubular portion 10 of the central terminal mounting section 11. The seal retention member 84 is attached to the inside of the tubular portion 10 by inserting the engaging leg into the seal retention member receiving groove 14A. The removable cover 78 is mounted on the socket body 1 by engaging the engaging projections 82 with the engaging holes 79 so as to protect the inside unit 54. The cover may be eliminated by integrally molding it with the inside unit 54.

Figure 15A:
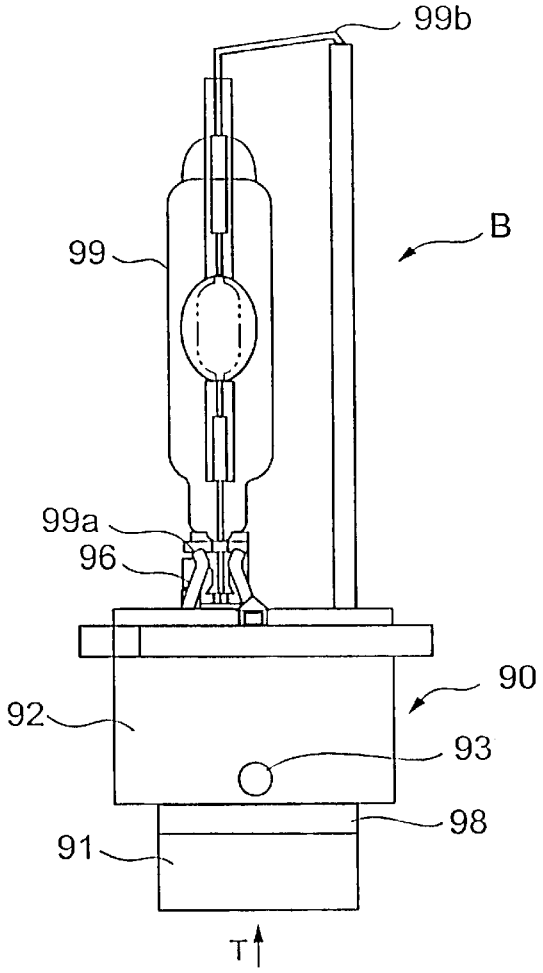
FIG. 15A is a side view of a lamp.
Figure 15B:
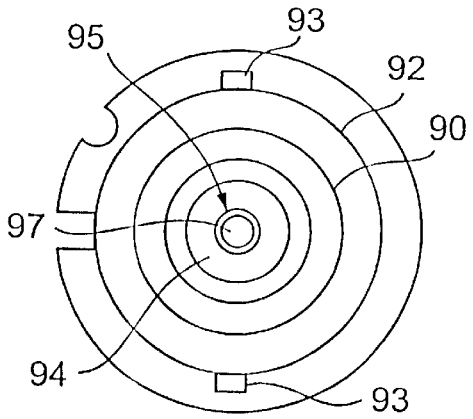
FIG. 15B is a diagram as viewed from an arrow T in FIG. 15A.

As shown in FIG. 15, the lamp B comprises a lamp body 90 that has a plug section 91 and an engaging section 92 with an engaging pin 93 for engagement with the lamp engaging section 8 of the lamp socket A. A circular indentation 94 is provided in the end face of the plug section 91. A lamp terminal 95 is mounted at the center of the lamp body 90. The connection section 96 of the lamp body 95 extends upwardly from the lam body 90. A contact section 97 of the lamp terminal 95 projects into the circular indentation 94. An annular contact section 98 is provided on the side face of the plug section 91.

A bulb 99 is connected to the connection section 96 of the lamp terminal 95 such that the contact points 99*a* and 99*b* of the bulb are connected to the lamp terminal 95 and the contact section 98, respectively. The plug section 91 of the lamp B is plugged into the plug section 7 of the socket A such that the engaging pins 93 are inserted into the insertion grooves 19, Then, the lamp B is rotated to engage the engaging pins 93 with the engaging apertures 18. The contact section 97 of the lamp terminal 95 is brought into contact with the contact section 37 of the terminal 3 and the contact portion 98 of the plug section 91 is brought into contact with the contact section 43*a* of the terminal 4.

As has been described above, according to the invention, the inside unit 54 is put into the unit storage section 81, the central terminal 3 is mounted on the terminal mounting aperture 11A while the low-voltage output terminal 77 is connected to the peripheral terminal 4, and the cover member 78 is put over the inside unit 54 to assemble the lamp socket A so that the number of assembling steps can be reduced. Since the inside unit 54 is housed in the storage section 81 of the lamp socket 1, it is not necessary to fill the unit storage section 81 with a resin under vacuum, making the assembling easier.

The inside unit 54 comprises the board 55 made by stamping a conductive plate, the unit body 54A made by molding the board 55 with a resin, and a plurality of electronics components mounted on the board 55. The starter circuit E is made by cutting the board 55 on which the unit body 54A has been made so that it is easy to make not only the starter circuit E but also the electronic components unit. When the transformer storage section 70 and the inside unit 54 are put in the storage rooms 25 and 26, respectively, of the unit storage section 81, a resin may be filled in the storage room 26 to protect the electronics components from vibrations and/or moisture or water.

As has been described above, the lamp socket according to the invention, comprises the inside unit housed in the unit storage section such that the high-voltage and low-voltage output terminals are brought into contact with the central and side terminals, respectively, and the cover is put over the inside unit to assemble the lamp socket so that the number of assembling steps can be reduced with keeping the inside electronic circuit and components intact.

The inside unit comprises the board made by stamping a conductive plate, the unit body made by molding the board, and the electronic components mounted on the board, and the circuit section is made by cutting the board after the unit body is made so that it is easy to make the circuit section and the electronic components unit.

When the transformer storage section 70 and the inside unit 54 are put in the storage rooms 25 and 26, respectively, of the unit storage section 81, a resin may be filled in the storage room 26 to protect the electronics components from vibrations and/or moisture or water.

As has been described above, the lamp socket according to the invention, comprises the inside unit 54 housed in the unit storage section 81 such that the high-voltage and low-voltage output terminals 76 and 77 are brought into contact with the central and side terminals 3 and 4, respectively, and the cover member 78 is put over the inside unit to assemble the lamp socket A so that the number of assembling steps can be reduced with keeping the inside electronic circuit and components intact. Since the inside unit 54 is housed in the unit receiving section 81 of the lamp socket section 1, it is not necessary to fill the unit receiving section 81 with a resin under vacuum, further facilitating the assembling.

Since the high-voltage and low-voltage output terminals 76 and 77 are separated by the separation wall 24 and the insulation seal 80, the lamp socket has a high break-down voltage and neither spark occurring between the output terminals 76 and 77 nor leak of the high voltage.

As has been described above, according to the invention, the inside unit is housed in the unit receiving section and the high-voltage and low-voltage output terminals are brought into contact with the central and side terminals to assemble the lamp socket. Since the high-voltage and low-voltage output terminals are separated by the insulation seal, the lamp socket has a high break-down voltage and neither spark between the output terminals nor leak of the high voltage.

What is claimed is:

1. A lamp socket comprising:

a socket body with a socket cavity into which a plugging section of a lamp is plugged;

a central terminal provided at a center of said socket cavity for contact with a lamp terminal of said lamp;

a side terminal provided in a side wall of said socket cavity for contact with a contact section of said plugging section;

a unit receiving section provided in said socket body at a position opposite to said socket cavity;

said socket body, said central terminal, said side terminal, and said unit receiving section constituting a lamp socket unit;

an inside unit including a circuit section for starting said lamp and high-voltage and low-voltage output terminals connected to said circuit section; said inside unit being housed in said unit receiving section such that said high-voltage and low-voltage output terminals are brought into contact with said central and side terminals, respectively.

2. The lamp socket according to claim 1, which further comprises a connector section for connecting said circuit section to a power source.

3. The lamp socket according to claim 1 or 2, which further comprises a cover for covering said inside unit in said unit receiving section.

4. The lamp socket according to claim 1 or 2, wherein said inside unit comprises:

a board of a conductive plate;

a unit body including said board;

a plurality of electronics components mounted on said board to form said circuit section.

5. A lamp socket comprising:

a socket body with a socket cavity into which a plugging section of a lamp is plugged;

a central terminal provided at a center of said socket cavity for contact with a lamp terminal of said lamp;

a side terminal provided in a side wall of said socket cavity for contact with a contact section of said plugging section;

a unit receiving section provided in said socket body at a position opposite to said socket cavity;

said socket body, said central terminal, said side terminal, and said unit receiving section constituting a lamp socket unit;

an inside unit including a circuit section for starting said lamp and high-voltage and low-voltage output terminals connected to said circuit section;

said unit receiving section being divided into first and second storage rooms such that said first and second storage rooms receive said central and side terminals, respectively;

a seal abutment section provided in either said first storage room or said inside unit so as to surround said central terminal;

a seal mounting section provided in said second storage room so as to surround said high-voltage output terminal;

a dielectric seal member provided in the seal mounting section;

said inside unit being housing in said unit receiving section so that not only said high-voltage and low-voltage terminals are brought into contact with said central and side terminals, respectively, but also said dielectric seal member into abutment with said seal abutment section.

6. The lamp socket according to claim 5, which further comprises a separation wall in said unit receiving section so as to separate said first and second storage rooms.

7. The lamp socket according to claim 6, which further comprises a connection terminal for connecting said low-voltage output terminal with said side terminal to bring said low-voltage output terminal to said side terminal.

* * * * *